US010211603B2

(12) United States Patent
Dorsch et al.

(10) Patent No.: US 10,211,603 B2
(45) Date of Patent: Feb. 19, 2019

(54) SURGE PROTECTION ELEMENT

(71) Applicant: EPCOS AG, Munich (DE)

(72) Inventors: Eduard Dorsch, Dallgow (DE); Frank Werner, Berlin (DE); Peter Bobert, Falkensee (DE); Thomas Westebbe, Berlin (DE)

(73) Assignee: EPCOS AG, Munich (DE)

( * ) Notice: Subject to any disclaimer, the term of this patent is extended or adjusted under 35 U.S.C. 154(b) by 246 days.

(21) Appl. No.: 15/121,757

(22) PCT Filed: Feb. 3, 2015

(86) PCT No.: PCT/EP2015/052171

§ 371 (c)(1),
(2) Date: Aug. 25, 2016

(87) PCT Pub. No.: WO2015/128159

PCT Pub. Date: Sep. 3, 2015

(65) Prior Publication Data

US 2017/0077678 A1 Mar. 16, 2017

(30) Foreign Application Priority Data

Feb. 25, 2014 (DE) ..... 10 2014 102 459

(51) Int. Cl.
*H01T 4/16* (2006.01)
*H01T 1/20* (2006.01)

(52) U.S. Cl.
CPC ..... *H01T 4/16* (2013.01); *H01T 1/20* (2013.01)

(58) Field of Classification Search
CPC ..... H01T 4/16; H01T 1/20
See application file for complete search history.

(56) References Cited

U.S. PATENT DOCUMENTS

| | | | | |
|---|---|---|---|---|
| 3,989,985 | A | 11/1976 | Lange et al. | |
| 9,762,035 | B2 * | 9/2017 | Westebbe | H01T 4/12 |
| 2014/0198422 | A1 * | 7/2014 | Jones | H01G 4/30 361/91.1 |

FOREIGN PATENT DOCUMENTS

| | | | |
|---|---|---|---|
| CN | 101233659 | A | 7/2008 |
| CN | 102882130 | A | 1/2013 |
| DE | 202008016322 | U1 | 2/2009 |
| DE | 102011108858 | A1 | 1/2013 |
| EP | 1835578 | A1 | 9/2007 |
| EP | 2579400 | A1 | 4/2013 |
| JP | S59148091 | U | 10/1984 |
| JP | 2002246141 | A | 8/2002 |
| WO | 2009028881 | A2 | 3/2009 |
| WO | 2013014167 | A1 | 1/2013 |
| WO | 2013041150 | A1 | 3/2013 |

* cited by examiner

*Primary Examiner* — Zeev V Kitov
(74) *Attorney, Agent, or Firm* — Morgan, Lewis & Bockius LLP

(57) ABSTRACT

The invention specifies a surge protection element (100) comprising a first electrode (1), a second electrode (2) and a gas discharge chamber (10). The gas discharge chamber (10) is arranged between the first electrode (1) and the second electrode (2), wherein the surge protection element (100) comprises an intermediate electrode structure (3), which is arranged in the gas discharge chamber (10) and is electrically isolated from the first electrode and the second electrode (1, 2).

12 Claims, 1 Drawing Sheet

SURGE PROTECTION ELEMENT

The present invention relates to a surge protection element.

One object of the present invention is the disclosure of an improved surge protection element.

This object is fulfilled by the surge protection element with the characteristics described in the independent patent claim. Advantageous configurations and further developments are described in the dependent patent claims.

A proposed surge protection element, preferably a surge diverter, for example a gas discharge arrester, comprises a first electrode, a second electrode and a gas discharge chamber, which is arranged between the first electrode and the second electrode, wherein the surge protection element comprises an intermediate electrode structure, which is arranged in the gas discharge chamber and is electrically isolated from the first electrode and the second electrode. The gas discharge chamber is preferably a continuous gas discharge chamber. The surge protection element is also preferably configured for the discharge of a gas in the gas discharge chamber, thereby forming an electrically conductive connection between the first electrode and the second electrode.

The discharge of gas, and/or the gas discharge chamber for the discharge of a gas, for example an inert gas, is appropriately arranged for the suppression of an overvoltage.

Moreover, the surge protection element is appropriately arranged for the protection of a further component, for example an electronic component, against said overvoltage. The term overvoltage preferably designates voltages in excess of a service voltage or voltage threshold, with effect from which said component may be damaged or destroyed. Specifically, the surge protection element is preferably configured such that an arc ignition voltage on the surge protection element, which forms, for example, as a result of an overvoltage present on the surge protection element, is increased or is provided with an exceptionally high rating, in comparison with a conventional surge protection element and/or a surge protection element from the prior art. Specifically, by an increased arc ignition voltage, the follow current extinguishing capability of the surge protection element can be improved or optimized.

Specifically, the term follow current or secondary current designates a current between the first electrode and the second electrode, which occurs after the ignition of a gas contained in the gas discharge chamber or after the formation of an arc between said electrodes. The secondary current may cause damage, specifically in the electronic component or in down-circuit electrical systems or networks, specifically where these show an exceptionally low internal electrical resistance.

Specifically, as a result of the presence of a follow current, further to the clearance of an overvoltage on the electrodes of the surge protection device, an arc may be generated, and this arc may be maintained for some time. If, for example, a network or service voltage on the electronic component is smaller than the arc ignition voltage, the surge protection element will extinguish the arc independently. For this reason, a high arc ignition voltage is preferred.

A further aspect of the invention relates to an electronic component with the surge protection element. The surge protection element is specifically designed for the protection of the electronic component against overvoltages.

In a preferred embodiment, the intermediate electrode structure, considered in an overhead view of the surge protection element, circumferentially encloses the first electrode with a constant clearance. By this arrangement, specifically, the arc ignition voltage of the surge protection element, for example in comparison with a conventional surge protection element, can be increased, as the electrical resistance between the first electrode and the second electrode can be increased by the coaxial or concentric geometry of the first and the second electrode, and by the arrangement of the intermediate electrode structure, for example during the formation of an arc or the discharge of gas between the electrodes.

In a preferred embodiment, the second electrode and/or the intermediate electrode structure shows a ring-like configuration.

The second electrode and the intermediate electrode structure can be arranged concentrically to the first electrode. This concentricity preferably designates the arrangement of the above-mentioned components in or along a common center, wherein the individual components may show different clearances or different radii in relation to the center. In an overhead view of the surge protection element, the term center, for example, designates a center of gravity or center of mass of the latter.

As an advantage of the concentric, circumferential and/or rotationally-symmetrical geometry described, in consideration of a plurality of potential ignition points or ignition sites between the intermediate electrode structure and the electrodes, the electrical resistance between the first electrode and the second electrode can be increased throughout, such that the arc ignition voltage of the surge protection element is also increased. For example—in the event of a gas discharge associated with an overvoltage—a current in at least one part of the gas discharge chamber, for example between the first electrode and the intermediate electrode structure, may flow at a large angle, for example 90°, relative to a current flow between the intermediate electrode structure and the second electrode, as a result of which the overall electrical resistance is increased.

In a preferred embodiment, the surge protection element is provided with a main axis. The main axis preferably runs through the above-mentioned center.

In a preferred embodiment, the first electrode is a central electrode of the surge protection element, wherein the second electrode and the intermediate electrode structure are arranged near the first electrode. The second electrode and the intermediate electrode structure, considered in an overhead view of the surge protection element, are preferably arranged circumferentially around the first electrode. Specifically, by this arrangement, the arc ignition voltage of the surge protection element can be increased, as described above.

The first electrode and the second electrode are preferably main electrodes of the surge protection element. According to this embodiment, the first electrode is appropriately arranged in the main axis of the surge protection element.

In a preferred embodiment, the intermediate electrode structure subdivides the gas discharge chamber into a plurality of gas-permeably interconnected compartments. Preferably, in this connection, the term "gas-permeable" indicates that, notwithstanding the arrangement of the intermediate electrode structure, the gas discharge chamber constitutes a continuous gas discharge chamber. For example, a reciprocal action of gas may occur, specifically as a result of pressure and temperature variations between the different compartments. In other words, the different compartments are not gas-tight. By this arrangement, it can advantageously be achieved, conversely to a series arrangement of mutually hermetically-sealed individual gas discharge arresters, for example, that the pressure, temperature or discharge states of the gas present in the gas discharge chamber can have an effect from one compartment to the next and/or that the compartments mutually interact in respect of the pressure, temperature or ionization state of the gas. This arrangement can also improve the follow current extinguishing capability of the surge element, by an increase in the arc ignition voltage.

The arrangement of the intermediate electrode structure, as described above, can be associated from the outset with a higher targeted arc ignition voltage, and also with an increase in the striking voltage of the surge protection element, as the electrical resistance of the arcing path is increased by means of subdivision into compartments or partial discharges. Preferably, however, the increase in the striking voltage across the gas-permeably connected compartments is not so strong as would be the case, if the surge protection element were comprised solely, for example, of a series arrangement or end-to-end arrangement of mutually gas-tight gas discharge arresters or gas chambers. If, for example, a partial discharge is triggered between the first electrode and the intermediate electrode structure, the pressure and temperature, for example, of the gas in this compartment may increase, as a result of which, by the above-mentioned reciprocal action of gas, the generation of an arc and/or a further partial discharge, for example between the intermediate electrode structure and the second electrode, associated with the increased pressure and/or the increased temperature will not occur so readily, or preferably can be prevented.

In a preferred embodiment, the intermediate electrode structure effects an increase in the arc ignition voltage, as a result of an overvoltage applied to the surge protection element.

In a preferred embodiment, the first electrode, the intermediate electrode structure and the second electrode are configured in a mutually equidistant arrangement. This arrangement is advantageous in respect of the generation of a gas discharge in the event of an overvoltage between the electrodes. Specifically, by this arrangement, gas discharge or arcing between the first electrode and the intermediate electrode structure can occur with the same probability as between the intermediate electrode structure and the second electrode.

In a preferred embodiment, the first electrode and the second electrode are configured in a mutually offset axial arrangement. This arrangement and/or geometry can advantageously facilitate the mutual electrical isolation of the first electrode and the second electrode.

In a preferred embodiment, the intermediate electrode structure is provided with an axial area in which the latter overlaps with the first electrode, but not with the second electrode.

In a preferred embodiment, the intermediate electrode structure is provided with an axial area, in which the latter overlaps with the second electrode, but not with the first electrode.

In these last two embodiments, advantageously, the relative arrangement of the first and second electrodes and the intermediate electrode structure can be facilitated and/or the mutual clearances between the above-mentioned components can be defined such that, specifically, the electrical isolation of the first and the second electrodes can be facilitated.

In a preferred embodiment, the intermediate electrode structure is provided with a plurality of mutually equidistant, considered in an overhead view of the surge protection element, and mutually electrically-isolated electrode elements. By this arrangement, the arc ignition voltage—corresponding to the number of electrode elements provided in the intermediate electrode structure—can be further increased and/or the follow current extinguishing capability of the surge protection element can be improved. To this end, each electrode element is preferably configured in an annular or ring-like arrangement. The electrode elements are also provided with appropriate mutual electrical isolation.

In a preferred embodiment, the intermediate electrode structure is provided with only two electrode elements.

In a preferred embodiment, the intermediate electrode structure is provided with inner and outer electrode elements, wherein the inner and the outer electrode elements respectively are configured in an annular or ring-like arrangement.

In a preferred embodiment, the inner and outer electrode elements are configured in a mutually offset axial arrangement. This arrangement and/or geometry can, however, advantageously facilitate the mutual electrical isolation of the inner electrode element and the outer electrode element.

In a preferred embodiment, the first electrode, the inner electrode element, the outer electrode element and the second electrode, in this sequence, are configured in a mutually offset sequential axial arrangement.

In a preferred embodiment, the surge protection element is provided with an insulating structure having at least one radial contact surface which, in turn, cooperates with a radial surface or radial contact surface of the first and/or second electrode. Each radial contact surface preferably extends in a direction defined by the main axis such that, for example, a perpendicular line to the radial contact surface shows a radial arrangement.

In a preferred embodiment, the insulating structure is provided with a first and a second substantially rotationally-symmetrical insulating element, wherein each insulating element has a contact stage with a radial contact surface and an axial contact surface. The above-mentioned contact surfaces are preferably configured such that the movement of components of the surge protection element cooperating with the latter is restricted. The above-mentioned axial contact surface is preferably oriented such that a perpendicular line to said surface is arranged in parallel with the main axis of the surge protection element. The rotational symmetry of the insulating elements, subject to minor deviations, can, for example, be achieved by means of fixing components or similar characteristics.

In a preferred embodiment, the contact stage of the first insulating element cooperates with the inner electrode element.

In a preferred embodiment, the contact stage of the second insulating element cooperates with the outer electrode element.

Here, the terms "cooperation" or "contact" signify that the components specified are touching, and are thus in mechanical contact, but are preferably not securely mechanically interconnected, such that the corresponding elements are provided with a degree of latitude. Thus, the clearances specified may also vary, in accordance with the latitude thus provided.

In a preferred embodiment, the first insulating element is configured in a ring-like arrangement, and is provided with a recess, wherein the first electrode projects into the recess.

In a preferred embodiment, the second insulating element is configured in an axially offset arrangement in relation to the first electrode.

In a preferred embodiment, the first insulating element defines the mutual axial offset of the inner and the outer electrode elements.

In a preferred embodiment, the first insulating element defines the radial clearance between the inner electrode element and the first electrode.

In a preferred embodiment, the second insulating element defines the axial offset of the inner and the outer electrode elements.

In a preferred embodiment, the second insulating element defines the radial clearance between the outer electrode element and the second electrode.

In a preferred embodiment, the insulating structure, for example by means of the arrangement of the first insulating element and the second insulating element, defines the radial clearance between the inner electrode element and the outer electrode element.

By means of the seven above-mentioned embodiments, the mutual electrical isolation of the first electrode, the inner electrode element, the outer electrode element and the second electrode can be advantageously facilitated.

By the definition or restriction of clearances, simply by the cooperation of the insulating structure or insulating elements with the electrodes or the intermediate electrode structure, or vice versa, the above-mentioned configuration of the continuous gas discharge chamber, wherein a gas-permeable connection between the individual compartments is maintained, can be advantageously achieved as, in this arrangement, there is preferably no gas-tight separation of the compartments in the gas discharge chamber.

In a preferred embodiment, the clearance between the first electrode and the inner electrode element, the clearance between the inner electrode element and the outer electrode element and/or the clearance between the outer electrode element and the second electrode lies between 0.5 mm and 0.8 mm respectively.

Further advantages, advantageous embodiments and appropriate features of the invention proceed from the following description of exemplary embodiments, in conjunction with the figures.

In the figures, equivalent, similar and identically-acting elements are identified by the same reference numbers. The mutual outlines and proportions of the elements represented in the figures are not shown to scale. In practice, in the interests of clarity and/or improved understanding, individual elements may be represented over-scale.

Figure 1:
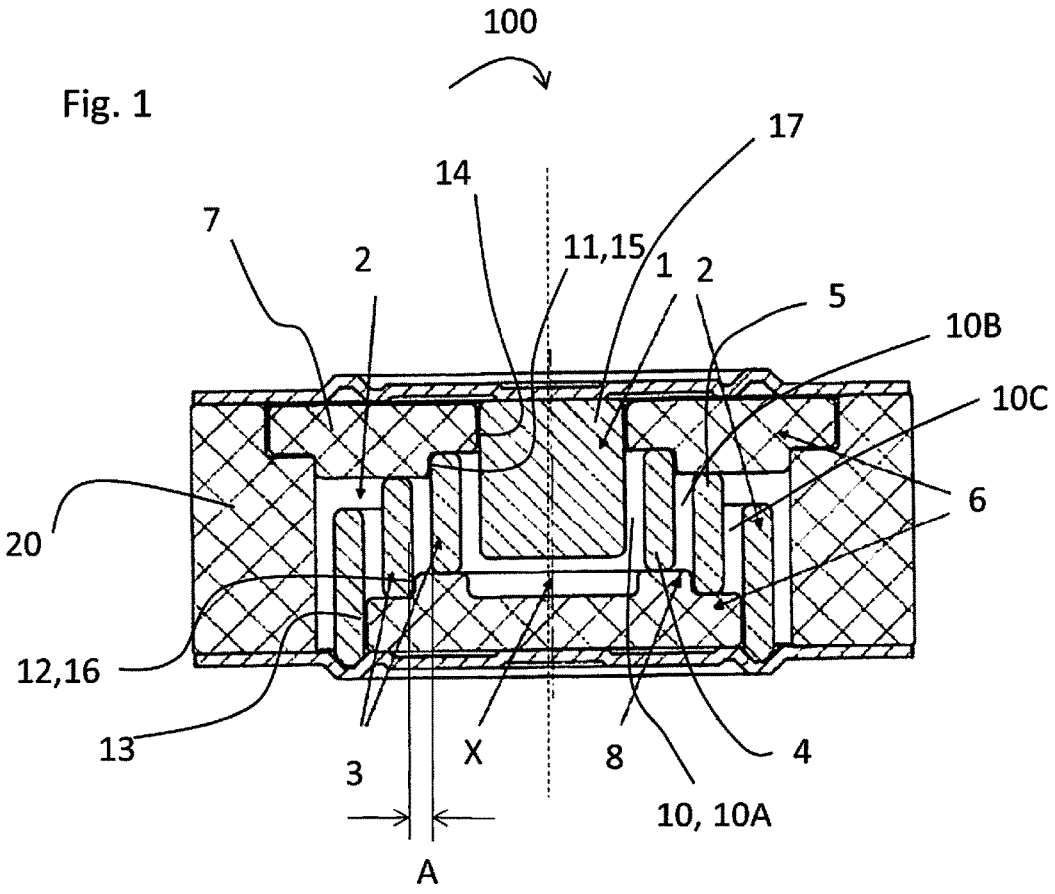
FIG. 1 shows at least a partial cross section of a surge protection element according to an exemplary embodiment.

FIG. 1 shows a cross section of a surge protection element 100 in an exemplary embodiment. The surge protection element 100 is provided with a housing 20. The housing 20 is preferably electrically insulating.

The surge protection element 100 is preferably intended for the protection, for example, of an electronic component (not explicitly represented) against overvoltages, and is designed accordingly.

Figure 2:
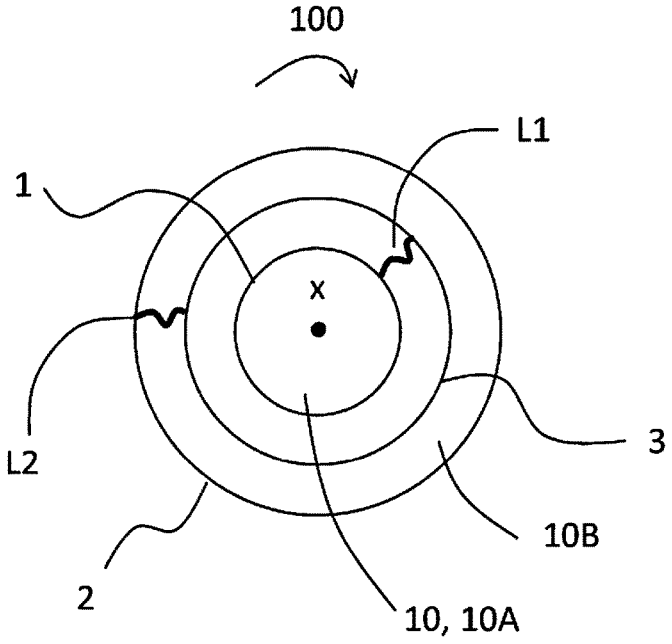
FIG. 2 shows a schematic overhead view of at least part of a surge protection element.

The surge protection element 100 is provided with a first electrode 1. The first electrode 1 is preferably a central electrode or middle electrode. The surge protection element 100 also has a main axis X, in which the first electrode 1 is centrally arranged. The surge protection element 100 is also provided with a second electrode 2. The first electrode 1 and the second electrode 2 are preferably main electrodes of the surge protection element 100. The second electrode 2, considered in an overhead view of the surge protection element 100 (c.f. FIG. 2) is arranged concentrically to the first electrode 1, or circumferentially to the first electrode 1 (c.f. FIG. 2). Appropriately, the second electrode 2 is also electrically isolated from the first electrode 1. Moreover, the second electrode 2 is preferably configured in an annular arrangement.

For the electrical connection of the first and second electrodes 1, 2, the surge protection element may be provided with electrical terminal contacts, for example on an upper side and underside of the surge protection element 100, although these are not explicitly represented in FIG. 1.

The surge protection element 100 is also provided with a gas discharge chamber 10. The gas discharge chamber 10 is arranged between the first electrode 1 and the second electrode 2. The gas discharge chamber 10 is preferably formed or defined by an axial overlap between the first electrode 1 and the second electrode 2. The first electrode 1 and the second electrode 2 are configured in a mutually offset axial arrangement.

The intermediate electrode structure 3 is preferably provided with an axial area, in which the latter overlaps with the first electrode 1, but not with the second electrode 2. Moreover, the intermediate electrode structure 3 is preferably provided with an axial area, in which the intermediate electrode structure 3 overlaps with the second electrode 2, but not with the first electrode 1.

The surge protection element 100 is also provided with an intermediate electrode structure 3. The intermediate electrode structure 3 is arranged in the gas discharge chamber 10. The intermediate electrode structure 3 is arranged circumferentially around the first electrode 1, preferably with a constant clearance. The intermediate electrode structure 3 comprises an inner electrode element 4. The intermediate electrode structure 3 also comprises an outer electrode element 5. Alternatively, the intermediate electrode structure 3 can be provided with further, for example concentrically-arranged and mutually electrically isolated electrode elements. The inner electrode element 4 and the outer electrode element 5, considered in an overhead view of the surge protection element 100, are preferably concentrically arranged circumferentially around the first electrode 1 and/or the second electrode 2 or, for example, around the first electrode 1. The inner electrode element 4 and the outer electrode element 5 are also preferably configured in an annular arrangement, and are appropriately provided with mutual electrical isolation.

The inner electrode element 4 and the outer electrode element 5 are also configured in a mutually axial offset arrangement, but with a mutual axial overlap. The first electrode 1, the inner electrode element 4, the outer electrode element 5 and the second electrode 2 are preferably configured, in this sequence, in a mutually offset sequential axial arrangement (from top to bottom in FIG. 1).

The surge protection element 100 is also provided with an insulating structure 6. The insulating structure 6 is concentrically or coaxially arranged to the first electrode 1. The insulating structure 6 is provided with a first insulating element 7. The first insulating element 7 is configured in a ring-like arrangement. The first insulating element 7 is provided with a recess 17, into which the first electrode 1 projects. The insulating structure 6 is also provided with a second insulating element 8. The second insulating element 8 is offset in relation to the first electrode 1, such that there is no axial overlap between the above-mentioned components.

Overall, the inner electrode element 4 and the outer electrode element 5 of the intermediate electrode structure 3 and the second electrode 2 are arranged concentrically to the first electrode 1, and with an axial offset in relation to the latter. By the arrangement of the intermediate electrode structure 3, the gas discharge chamber 10 is subdivided into a plurality of gas-permeably interconnected compartments 10A, 10B and 10C, which are arranged for the reciprocal action of gas.

The first insulating element 7 is provided with a radial contact surface 14, which borders the first insulating element 7, or the annular element thereof, on one inner side. By means of the radial contact surface 14, the first insulating element 7 cooperates with a radial outer surface (not explicitly represented) of the first electrode 1.

The second insulating element 8 is provided with a radial contact surface 13, which borders the second insulating element 8 on one outer side. By means of the radial contact surface 13, the second insulating element 8 cooperates with a radial inner surface (not explicitly represented) of the second electrode 2.

The first insulating element 7 is also provided with an inner contact stage 15. The contact stage 15 is provided with a radial contact surface 11 and, for the formation of the stage, an axial contact surface which is not explicitly represented. The second insulating element 8 is comparably provided with an outer contact stage 16. The contact stage 16 is provided with a radial contact surface 12 and also, for the formation of the stage, an axial contact surface (not explicitly represented).

Preferably, the insulating structure 6, specifically the first insulating element 7 and the second insulating element 8—by means of the above-mentioned contact surfaces and contact stages—defines the clearances between the first electrode 1, the second electrode 2 and the intermediate electrode structure 3, for the purposes of the electrical isolation of the above-mentioned components.

By means of the contact surfaces 11, 14 and/or the contact stages 15, the first insulating element 7 preferably defines the axial offset between the inner and outer electrode elements 4, 5, and the radial clearance between the inner electrode element 4 and the first electrode 1. By means of the contact surfaces 12, 13 and/or the contact stages 16, the second insulating element 8 also defines the axial offset between the inner and outer electrode elements 4, 5, and the radial clearance between the outer electrode element 5 and the second electrode 2.

For example, by means of the arrangement of the first insulating element 7 and the second insulating element 8, the insulating structure 6 also defines the radial clearance (marked "A" in FIG. 1) between the inner electrode element 4 and the outer electrode element 5.

In a composition of the surge protection element, for example, the inner electrode element 4 may be inserted in the first insulating element 7 and/or clamped to the latter, or vice versa, such that the radial clearance, for example for the purposes of electrical isolation, between the inner electrode element 4 and the first electrode 1 is defined. Moreover, the second insulating element 8 is preferably inserted in the annular second electrode 2, and the outer electrode element 5 is arranged or fitted around the contact stage 16 of the second insulating element 8 such that, for example, for the purposes of the corresponding electrical isolation, the radial clearance between the outer electrode element 5, the inner electrode element 4 and the second electrode 2 is defined or determined.

For the definition of the above-mentioned clearances, the insulating structure 6 is preferably in contact with the first electrode 1, the intermediate electrode structure 3 and the second electrode 2, but is not securely mechanically connected to the above-mentioned components.

The first electrode 1, the inner electrode element 4, the outer electrode element 5 and the second electrode 2 are preferably spaced or arranged radially (and thus horizontally in FIG. 1) in a mutually equidistant concentric arrangement. The above-mentioned equidistant clearances may lie within the range of 0.5 mm to 0.8 mm respectively.

Alternatively, for example, the clearance between the first electrode 1 and the inner electrode element 4, the clearance between the inner electrode element 4 and the outer electrode element 5 and/or the clearance between the outer electrode element 5 and the second electrode 2 may deviate from each other.

Preferably, the surge protection element 100 and/or the specified components thereof are at least substantially configured in a rotationally symmetrical arrangement, for example to the main axis.

FIG. 2 shows a schematic overhead view of the surge protection element 100, representing the first electrode 1, the second electrode 2 and the intermediate electrode structure 3 respectively. A first arc L1, generated between the first electrode 1 and the intermediate electrode structure 3, is also represented. A second arc L2, generated between the intermediate electrode structure 3 and the second electrode 2, is also represented. The arcs may be generated as a consequence of an overvoltage applied, for example, between the electrodes 1, 2 to the surge protection element 100. From FIG. 2, it will be seen that the electric current flows associated with the arcs L1, L2 are generated at a relatively large angle to each other—for example greater than 90°. As a result, specifically, the electrical resistance of the entire discharge path can be increased, and the arc ignition voltage of the surge protection element 100 can be advantageously increased.

In an alternative embodiment, rather than concentrically or coaxially as described above, the surge protection element 100 can be configured with a linear arrangement, for example of the first electrode, the intermediate electrode structure and the second electrode, whereby the advantages of a higher arc ignition voltage in the surge protection element can also be exploited.

The invention is not limited to the description of the exemplary embodiments. Rather, the scope of the invention includes any new characteristic or combination of characteristics, specifically including any combination of the characteristics described in the patent claims, even where this characteristic or this combination is not explicitly indicated in the patent claims or the exemplary embodiments.

LIST OF REFERENCE NUMBERS

1 First electrode
2 Second electrode
3 Intermediate electrode structure
4 Inner electrode element
5 Outer electrode element
6 Insulating structure
7 First insulating element
8 Second insulating element
10 Gas discharge chamber
10A, 10B, 10C Compartment
11, 12, 13, 14 Radial contact surface
15, 16 Contact stage
17 Recess

20 Housing
100 Surge protection element
X Main axis

The invention claimed is:

1. The surge protection element, comprising:
a first electrode: a second electrode:
a gas discharge chamber arranged between the first electrode and the second electrode:
and an intermediate electrode structure arranged in the gas discharge chamber, the intermediate electrode structure being electrically isolated from the first electrode and the second electrode:
a radial surface of at least one of the first and second electrode:
an insulating structure having at least one radial contact surface, the radial contact surface cooperating with the radial surface: and
a first and a second insulating element each of the insulating elements having a contact
stage with a radial contact surface and an axial contact surface, the insulating structure being provided with the first and second insulating elements,
wherein the second insulating element is configured in an axially offset arrangement in relation to the first electrode.

2. A surge protection element comprising:
a first electrode: a second electrode:
a gas discharge chamber arranged between the first electrode and the second electrode:
and an intermediate electrode structure arranged in the gas discharge chamber, the intermediate electrode structure being electrically isolated from the first electrode and the second electrode,
wherein the intermediate electrode structure effects an increase in the arc ignition voltage, as a result of an overvoltage applied to the surge protection element.

3. The surge protection element according to claim 1 or 2, wherein the first insulating element is configured in a ring-like arrangement and is provided with a recess, the first electrode projecting into the recess.

4. A surge protection element comprising: a first electrode;
a second electrode;
a gas discharge chamber arranged between the first electrode and the second electrode; an intermediate electrode structure arranged in the gas discharge chamber, the intermediate electrode structure being electrically isolated from the first electrode and the second electrode;
an inner electrode element of the intermediate electrode structure, the inner electrode element being configured in an annular arrangement; and
an outer electrode element of the intermediate electrode structure, the outer electrode element being configured in a further annular arrangement, and electrically isolated from the inner electrode element, and axially shifted with respect to the inner electrode element, the further annular arrangement of the outer electrode element being axially offset in relation to the inner electrode element.

5. The surge protection element according to claim 1 or 2, wherein the intermediate electrode structure circumferentially encloses the first electrode with a constant clearance.

6. The surge protection element according to claim 1 or 2, wherein the intermediate electrode structure subdivides the gas discharge chamber into a plurality of gas-permeably interconnected compartments.

7. The surge protection element according to claim 1 or 2, wherein the first electrode, the intermediate electrode structure and the second electrode are configured in a mutually equidistant arrangement.

8. The surge protection element according to claim 1 or 2, wherein the first electrode and the second electrode are configured in a mutually offset axial arrangement.

9. The surge protection element according to claim 1 or 2, further comprising:
a plurality of further electrode elements, the further electrode elements being mutually electrically-isolated when considered in an overhead view of the surge protection element; and
the intermediate electrode structure being provided with the plurality of further electrode elements.

10. The surge protection element according to claim 9, further comprising:
inner and outer electrode elements, the inner and the outer electrode elements being respectively configured in an annular arrangement, and the intermediate electrode structure being provided with the inner and outer electrode elements.

11. The surge protection element according to claim 10, wherein the outer electrode element is axially shifted with respect to the inner electrode element.

12. The surge protection element according to claim 1, wherein the contact stage of the first insulating element cooperates with an inner electrode element and the contact stage of the second insulating element cooperates with an outer electrode element.

* * * * *